United States Patent [19]

Neilsen

[11] 4,165,575

[45] Aug. 28, 1979

[54] ROTARY CARD FILE

[75] Inventor: Hildaur L. Neilsen, Metuchen, N.J.

[73] Assignee: Rolodex Corporation, N.J.

[21] Appl. No.: 783,382

[22] Filed: Mar. 31, 1977

[51] Int. Cl.[2] ..... B42F 13/12

[52] U.S. Cl. ..... 40/379; 40/494; 40/497; 211/58

[58] Field of Search ..... 40/68, 68.4, 68.6, 72, 40/73.4, 74, 77.4, 111, 114, 119, 377–379, 493–494, 497–499, 503, 505; 211/53, 58, 115; 312/189, 328

[56] References Cited

U.S. PATENT DOCUMENTS

| | | | |
|---|---|---|---|
| 2,087,518 | 7/1937 | Lowe | 40/68 X |
| 2,231,029 | 2/1941 | Scholfield | 40/68.6 |
| 2,536,574 | 2/1951 | Scholfield et al. | 312/189 |
| 3,279,470 | 10/1966 | Neilsen | 40/68.6 |
| 3,634,958 | 1/1972 | Drowns | 40/493 |

FOREIGN PATENT DOCUMENTS

| | | | |
|---|---|---|---|
| 111667 | 10/1940 | Australia | 40/77.4 |

*Primary Examiner*—John F. Pitrelli
*Assistant Examiner*—G. Lee Skillington
*Attorney, Agent, or Firm*—Robert E. Burns; Emmanuel J. Lobato; Bruce L. Adams

[57] ABSTRACT

A plurality of rotatable card holders are disposed end-to-end on a horizontal fixed shaft supported at its ends by a tubular frame. Each of the card holders comprises two coaxial sections each of which is generally cylindrical with a peripheral web for holding the cards. Each of the cards has two notches for receiving the webs of the card holder so as to mount the card removably and hingedly on the card holder. At one end of each card holder there is provided a capstan having radially projecting spokes which extend out beyond the cards to provide means for manually rotating the card holder on the shaft. Between the two sections of each card holder there is provided a brake device comprising two H-shape members disposed respectively on opposite sides of the shaft and connected by two screws. The brake members have laterally projecting flange portions which engage radial spoke-like webs of the card holder sections so as to cause the brake device to rotate with the card holder and narrower central portions which frictionally engage the shaft between the two sections of the card holder. The screws are rotatable by means of a screwdriver inserted between the two card holder sections to adjust the force with which the brake members grip the shaft so as to permit rotation of the card holder by the capstan and yet retain the card holder in whatever position it has been turned by the capstan.

11 Claims, 4 Drawing Figures

FIG. 1
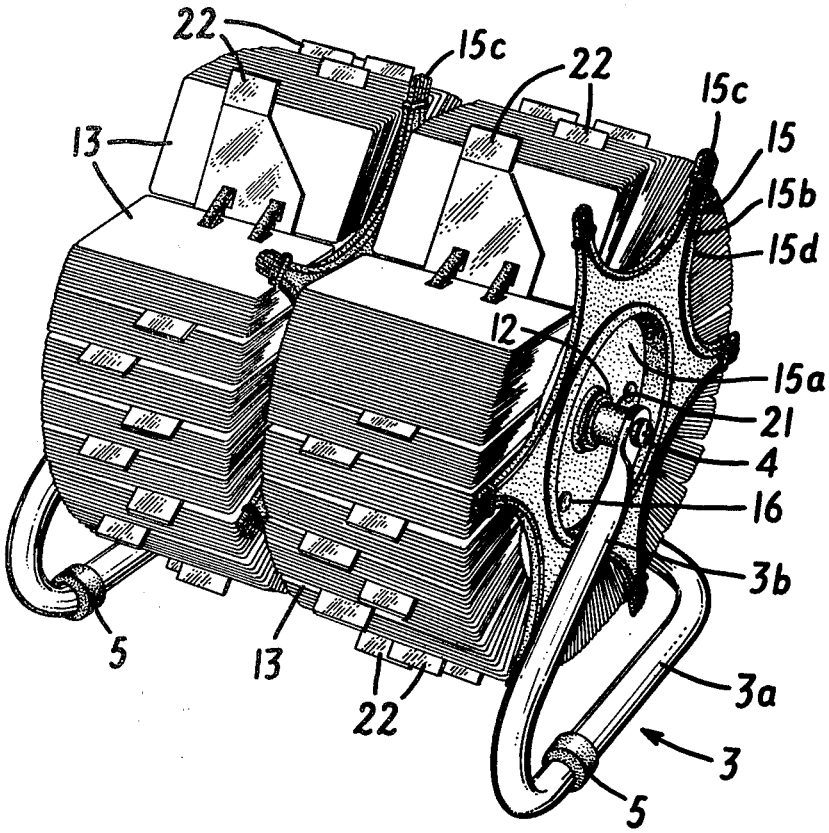
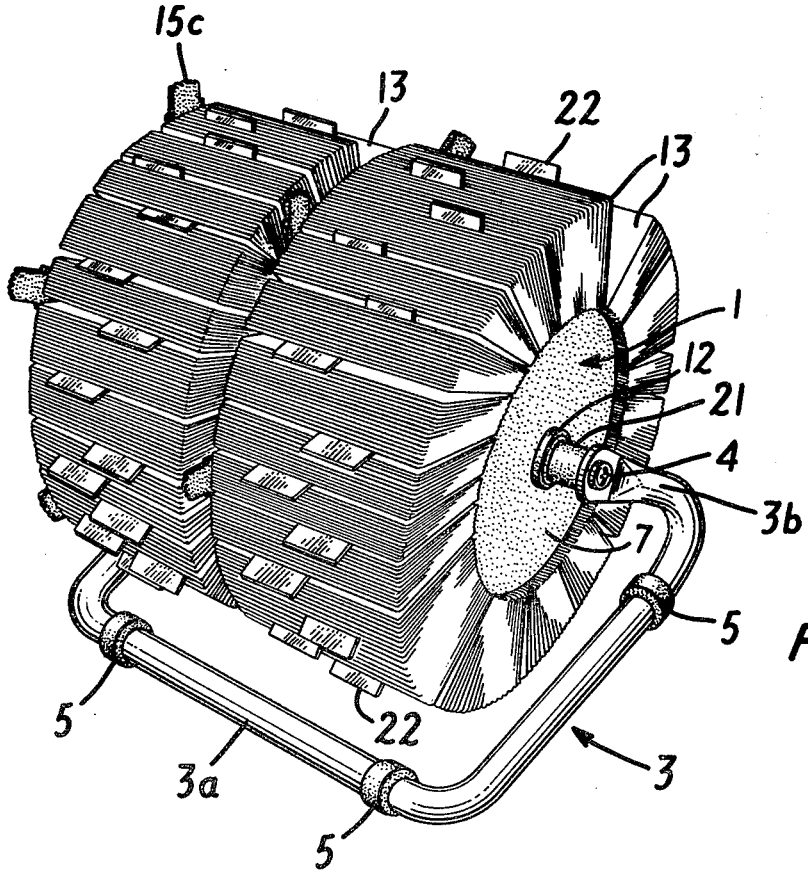
FIG. 2

ROTARY CARD FILE

FIELD OF INVENTION

The present invention relates to a rotary card file and in particular to a card file comprising a plurality of rotatable card holders disposed end-to-end on a fixed shaft and each provided with means for turning the individual card holder and for retaining it in the position to which it has been turned.

BACKGROUND OF THE INVENTION

A rotary card file customarily comprises a rotatable drum-like card holder provided on its periphery with two circumferentially extending webs with enlarged beads at their peripheries. The cards are provided at their inner edges with notches or slots which fit the webs of the card holder so as to retain the cards removably and hingedly on the card holder. Means is provided for manually rotating the card holder so as to make different cards available to the user and for retaining the card holder in the position to which it has been rotated.

SUMMARY OF THE INVENTION

It is an object of the present invention to provide a rotary card file comprising a rotatable card holder of improved construction with novel means for rotating the card holder on a stationary shaft and novel brake means for frictionally engaging the shaft to retain the card holder in the position to which it has been rotated. The novel construction in accordance with the present invention is applicable to card files having a single rotatable card holder and to multiple-unit rotary card files comprising two or more rotatable card holders disposed end-to-end on a common shaft.

In accordance with the invention a rotary card holder comprises two coaxial drum-like sections each of which has at its periphery a circumferentially extending web having at its outer edge an enlarged bead. The card holder supports a multiplicity of cards each of which has at its inner edge two slots of which one receives the peripheral web of one section of the card holder while the other receives the peripheral web of the other section. Between the two sections there is an adjustable brake device which rotates with the card holder and frictionally engages the stationary shaft between the two sections of the card holder so as to retain the card holder in a position to which it has been turned. For rotating the card holder on the shaft there is provided at one end of the card holder a capstan having radially projecting spokes which extend out beyond the cards for easy manual manipulation. A multiple-unit card file comprises two or more like card holders disposed end-to-end on a fixed horizontal shaft each of the card holders having a capstan for rotating it and a brake device for retaining the card holder in the position to which it has been rotated.

BRIEF DESCRIPTION OF DRAWINGS

The nature, object and advantages of the invention will be more fully understood from the following description of a preferred embodiment show by way of example in the accompanying drawings in which FIG. 1 is a front perspective view of a card holder in accordance with the present invention;

FIG. 2 is a rear persepctive view;

DESCRIPTION OF PREFERRED EMBODIMENT

Figure 3:
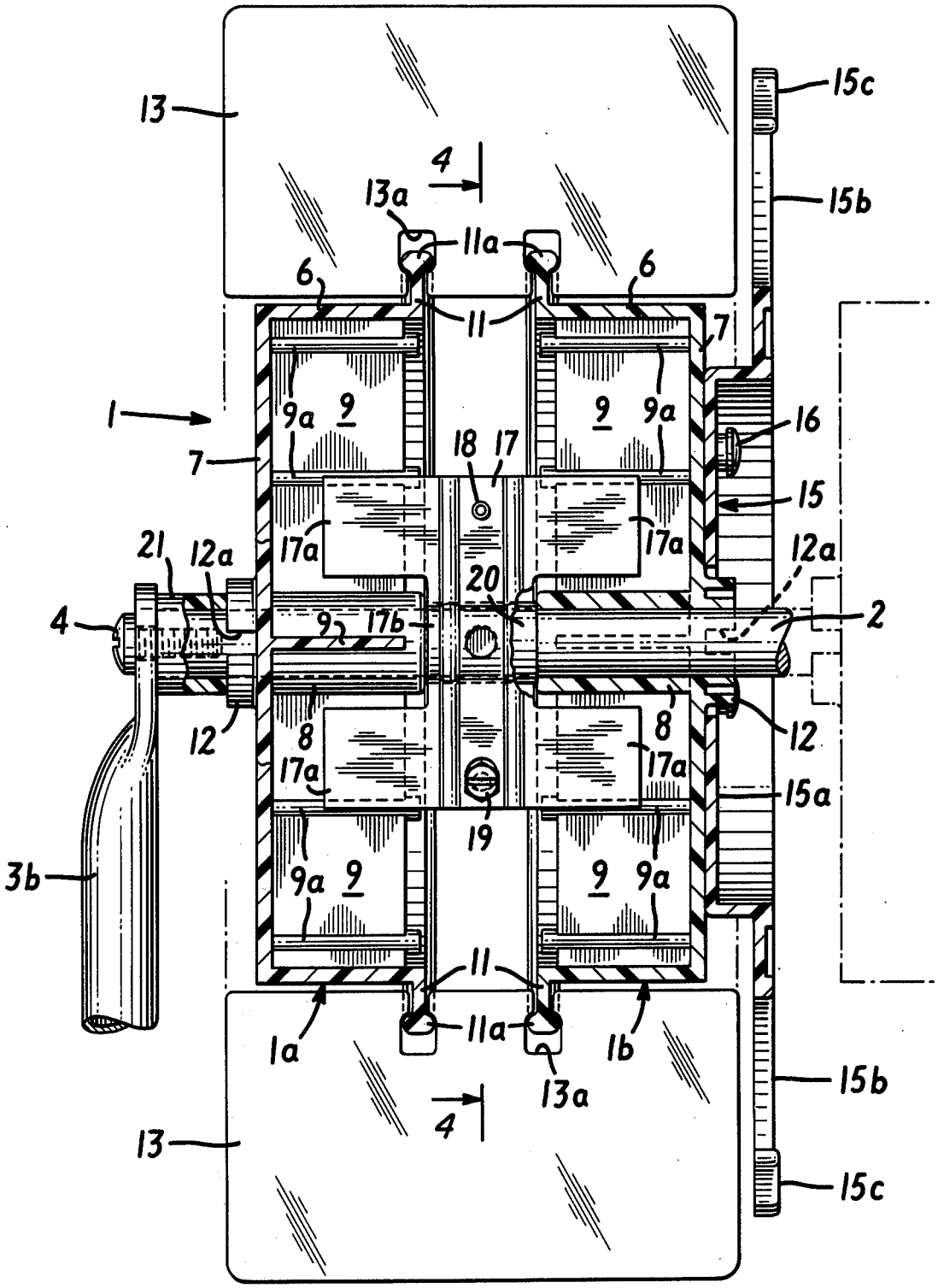
FIG. 3 is a longitudinal section of one card holder taken approximately on the line 3—3 in FIG. 4.
Figure 4:
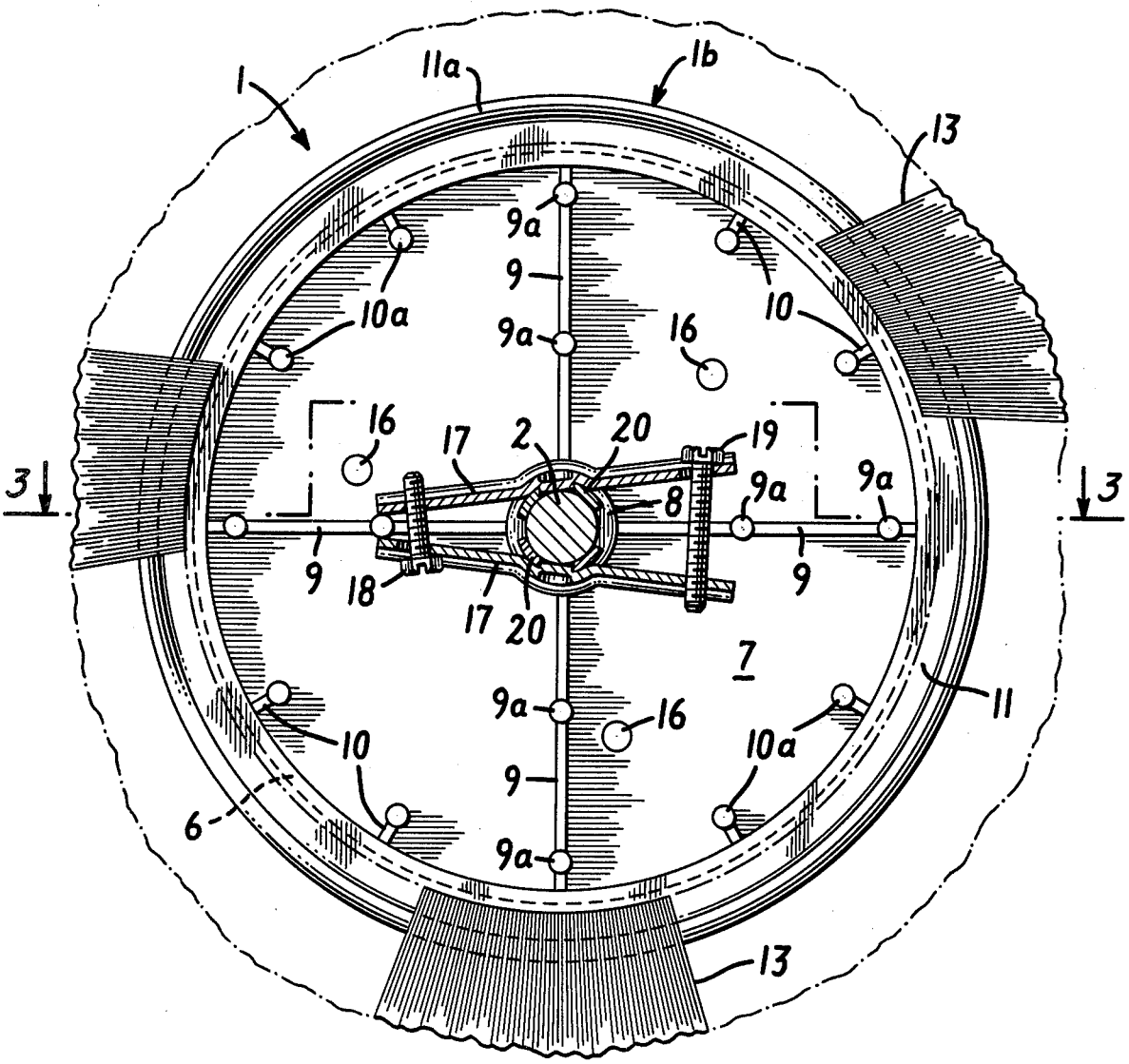
FIG. 4 is a cross section taken approximately on the line 4—4 in FIG. 3.

The construction in accordance with the invention is applicable to a single-unit card file and also to a multiple-unit card file having two or more rotary card holders. By way of example in the drawings there is shown a rotary card file in accordance with the invention having two rotatable card holders 1 disposed end-to-end on a horizontal shaft 2. The shaft is supported in a horizontal position by a bent tubular frame 3 having a U-shaped base portion **3*a* and upwardly inclined shaft-supporting portions 3*b* which are flatened and perforated at their upper ends to receive screws 4 which screw into end portions of the shaft so as to support it and keep it from rotating. Short sleeve sections 5 at spaced locations on the base portion 3*a*** of the frame provide a non-skid, non-scratching supporting for the frame on a desk top or other horizontal surface.

Each of the rotatable card holders 1 is composed of two drum-like sections **1*a* and 1*b* which are alike but are reversed relative to one another. Each section comprises a generally cylindrical peripheral wall 6, an end wall 7 -the other end being open- and a hub portion 8 by which the section is rotatable supported on the shaft 2. Four spoke-like webs 9 extend between the hub portion 8 and the peripheral wall 6 and are reenforced by beads 9*a*. The peripheral wall 6 is further strengthened by circumferentially spaced inwardly extending web portions 10 having enlarged beads 10*a* at their inner edges. Projecting radially outwardly from the peripheral wall 6 at the open end of each section there is an outwardly projecting circumferentially extending web 11 having at its outer edge a peripheral bead 11*a*. Projecting axially outwardly from a central portion of the end wall 7 there is a collar 12 having diametrically opposite slots 12*a*** therein. The entire card holder section as described is conveniently formed as an integral molding of plastic material.

The two sections **1*a* and 1*b* of each card holder 1 are rotatably disposed on the shaft 2 with their open ends facing one another and with the peripheral webs 11 suitably spaced to be received in undercut slots 13*a* provided in the inner edges of cards 13 carried by the holder. Through the interengagement of the slots 13*a* with the peripheral webs 11 of the card holder the cards are removably held on the holder and are capable of hinge-like movement about their inner edges so that an assembly of cards can be opened up as illustrated in FIG. 1** in order to view selected individual cards.

The card holder 1 is rotatable on the stationary horizontal shaft 2 by means of a capstan 15 affixed to the end wall 7 of one of the sections of the card holder. The capstan 15 comprises a central dished hub portion **15*a* which is suitably affixed to the end wall 7 of the card holder, for example by pins or rivets 16. A plurality of spoke portions 15*b* radiate from the hub portion 15*a*. The number of spokes may be varied but preferably is between three and eight. The spoke portions extend radially outwardly beyond the cards and are provided at their outer ends with ribbed portions 15*c* which are of attractive appearance and facilitate digitally engaging the ends of the spokes to rotate the card holder on the shaft 2. Adjacent spokes are joined with one another by outwardly concave curved edges 15*d* which give the capstan an attractive appearance and also strengthen the spokes. The capstan is conveniently molded of plastic material. When a plurality of card holders are mounted on a common shaft, as illustrated in FIGS. 1 and 2**, each is individually rotatable by its own capstan.

Moreover each of the card holders is provided internally with a brake device which frictionally grips the stationary shaft so as to retain the card holder in the position to which it has been rotated by means of the capstan. The brake device is shown by way of example as comprising two like H-shaped members 17 which are disposed on opposite sides of the shaft 2 and are connected with one another by screws 18 and 19. Each of the members 17 is wider at its opposite ends to provide laterally projecting wing portions 17*a* which project into the open ends of the opposed card holder sections 1*a* and 1*b*. Narrower central portions 17*b* of members 17 are disposed between the card holder sections 1*a* and 1*b* and are provided with arcuate brake shoes 20 which are engageable with the shaft 2. The brake device is assembled between the two sections of a card holder with the wings 17*a* of the two members 17 on opposite sides of spoke-like webs 9 of the card holder sections. The screw 18 is tightened so that spoke-like webs of the two card holder sections are gripped between the wing portions 17*a* of the opposed brake members 17 so that when the card holder is rotated on the shaft 2 the brake device must rotate with the card holder. The other screw 19 is then tightened sufficiently to frictionally grip the shaft 2 with the desired pressure between brake shoes 20 and thereby retain the card holder in the position to which it has been turned by the capstan. By reason of the symmetry of the brake device, the braking action is equal in both rotational directions. It will be noted that the screw 19 can be turned by a screw driver inserted between the two sections of the card holder to adjust the braking force as desired.

The desired number of card holders are assembled on the shaft 2 with short plastic sleeves 21 between adjacent card holders and between the card holders and the flatened end portions of the supporting frame 3. Cards 13 are then assembled on holders as desired, usually with interspersed index tabs 22. Particularly when there are two or more card holders, a rotary card file of large capacity is provided. The file is used by rotating the individual card holders by means of their respective capstans so as to present the desired cards to view.

While a preferred embodiment of the invention has been illustrated in the drawings and is herein particularly described it will be understood that many variations and modifications may be made and that the invention is thus in no way limited to the illustrated embodiments.

What is claimed is:

1. A rotary card file comprising a fixed shaft, means supporting said shaft horizontally, a plurality of card holders independently rotatable on said shaft, each of said card holders having peripheral means for removably holding cards, a multiplicity of cards disposed around each said card holder and removably and hingedly held by said card holding means, capstan means fixedly secured to each of said card holders at one end thereof for rotation therewith in both rotational directions, said capstan means comprising a central hub portion fixed to said card holder and a plurality of spokes projecting radially from said hub portion and extending radially beyond the periphery of said card holder, said spokes being positioned for manual engagement to rotate said card holder in both rotational directions on said shaft, and brake means for exerting a braking action on each of said card holders equally in both rotational directions, said brake means comprising two brake members rotatable with said card holder and disposed with said shaft between them, said brake members frictionally gripping said shaft to retain said card holder in a position to which it has been turned by said capstan means.

2. A rotary card holder according to claim 1, in which said spokes of said capstan means project radially outwardly beyond the cards on said holder.

3. A rotary card holder according to claim 1, in which said capstan means has from three to eight equally spaced spokes.

4. A rotary card file according to claim 2, in which adjacent spokes are joined by outwardly concave smooth curves.

5. A rotary card file according to claim 1, in which each of said spokes has a ribbed outer end portion for slip-resistant manual engagement of said spokes.

6. A rotary card file comprising a fixed shaft, means supporting said shaft horizontally, a card holder rotatable on said shaft and having peripheral means for removably holding cards, a multiplicity of cards disposed around said card holder and removably and hingedly held by said card holding means, manually engageable means at an end of said card holder for manually rotating said card holder on said shaft, and brake means disposed in said card holder intermediate its ends, said brake means being rotatable with said card holder and frictionally engaging said fixed shaft to retain said card holder in a position to which it has been turned by said manually engagable means, said brake means comprising two members disposed with said shaft between them, said members having opposite end portions, and means connecting said opposite end portions of one of said members with opposite end portions of the other of said members to grip said shaft between said members.

7. A rotary card file according to claim 6, in which said card holder comprises two coaxial sections and in which said brake means is disposed between said sections.

8. A rotary card file according to claim 6, in which said connecting means comprises screw means engageable and rotatable by a tool from outside said card holder to adjust the gripping of said shaft and hence the brake force provided by said brake means.

9. A rotary card filed according to claim 7, in which said sections have radially extending spoke portions and in which said members of said brake means have portions engaging said spoke portions to cause said members to rotate with said card holder.

10. A rotary card file according to claim 9, in which said members of said brake means are H-shaped with enlarged end portions engageable with said spoke portions of said sections of said shaft.

11. A rotary card filed according to claim 6, comprising a plurality of said card holders disposed end-to-end on said fixed shaft and independently rotatable thereon, each of said card holders having said means for manually rotating it and said brake means for retaining it in the position to which it has been rotated.

* * * * *